US006779673B2

(12) United States Patent
Melrose et al.

(10) Patent No.: US 6,779,673 B2
(45) Date of Patent: Aug. 24, 2004

(54) PLASTIC CONTAINER HAVING AN INVERTED ACTIVE CAGE

(75) Inventors: David Murray Melrose, Auckland (NZ); Scott E. Bysick, Lancaster, PA (US); George T. Harrell, York, PA (US); Richard K. Ogg, Littlestown, PA (US); Raymond A. Pritchett, Jr., Red Lion, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/196,551

(22) Filed: Jul. 17, 2002

(65) Prior Publication Data

US 2003/0015491 A1 Jan. 23, 2003

Related U.S. Application Data

(60) Provisional application No. 60/305,620, filed on Jul. 17, 2001.

(51) Int. Cl.[7] ..... B65D 90/02

(52) U.S. Cl. ..... 215/381; 215/382; 215/383; 220/675

(58) Field of Search ..... 215/379, 371–383; 220/666, 675

(56) References Cited

U.S. PATENT DOCUMENTS

| | | | | |
|---|---|---|---|---|
| D227,861 | S | | 7/1973 | Stanley |
| 4,372,455 | A | | 2/1983 | Cochran |
| 4,497,855 | A | | 2/1985 | Agrawal et al. |
| 4,805,788 | A | | 2/1989 | Akiho |
| 4,877,141 | A | | 10/1989 | Hayashi et al. |
| 5,054,632 | A | * | 10/1991 | Alberghini et al. ..... 220/675 X |
| 5,060,453 | A | * | 10/1991 | Alberghini et al. ..... 53/440 |
| 5,141,121 | A | | 8/1992 | Brown et al. |
| 5,178,290 | A | | 1/1993 | Ota et al. |
| 5,238,129 | A | | 8/1993 | Ota |
| 5,279,433 | A | | 1/1994 | Krishnakumar et al. |
| 5,303,834 | A | | 4/1994 | Krishnakumar et al. |
| 5,337,909 | A | * | 8/1994 | Vailliencourt ..... 220/675 X |
| 5,690,244 | A | | 11/1997 | Darr |
| 5,704,503 | A | | 1/1998 | Krishnakumar et al. |
| 5,704,504 | A | | 1/1998 | Bueno |
| 5,762,221 | A | | 6/1998 | Tobias et al. |
| 5,908,127 | A | * | 6/1999 | Weick et al. ..... 215/382 X |
| 5,908,128 | A | | 6/1999 | Krishnakumar et al. |
| 5,971,184 | A | | 10/1999 | Krishnakumar et al. |
| 6,044,996 | A | | 4/2000 | Carew et al. |
| 6,347,717 | B1 | * | 2/2002 | Eberle ..... 215/381 |
| 2002/0000421 | A1 | * | 1/2002 | Ota et al. |

FOREIGN PATENT DOCUMENTS

| | | |
|---|---|---|
| WO | WO 00/50309 | 8/2000 |

* cited by examiner

*Primary Examiner*—Sue A. Weaver
(74) *Attorney, Agent, or Firm*—James R. Burdett

(57) ABSTRACT

A container having an inverted active cage generally includes an enclosed base portion, a body portion extending upwardly from the base portion, and a top portion with a finish extending upwardly from the body portion. The body portion further includes a central longitudinal axis, a periphery, a plurality of active surfaces, and a network of pillars. Unlike the prior art, each of the plurality of active surfaces is outwardly displaced with respect to the longitudinal axis, while each of the network of pillars is inwardly displaced with respect to the longitudinal axis. The plurality of active surfaces, together with the network of pillars, are spaced about the periphery of the container in order to accommodate vacuum-induced volumetric shrinkage of the container resulting from a hot-filling, capping and cooling thereof.

29 Claims, 8 Drawing Sheets

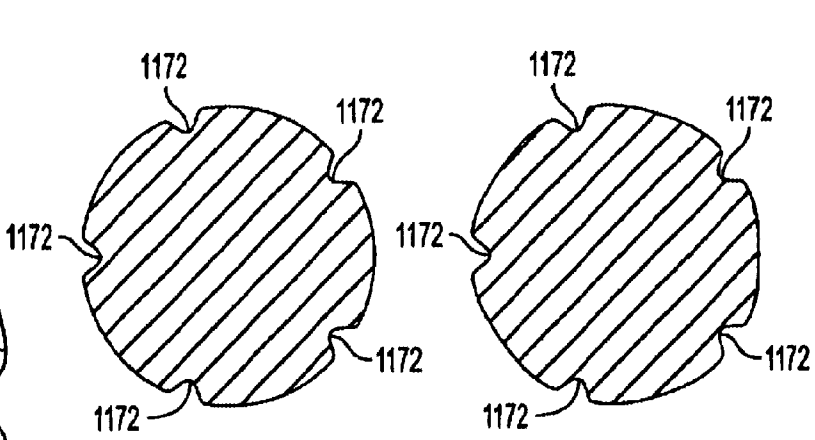
FIG. 13
FIG. 14
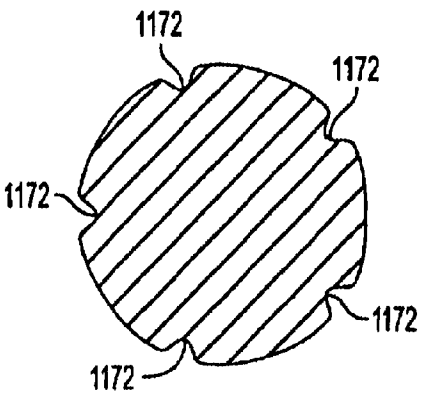
FIG. 15
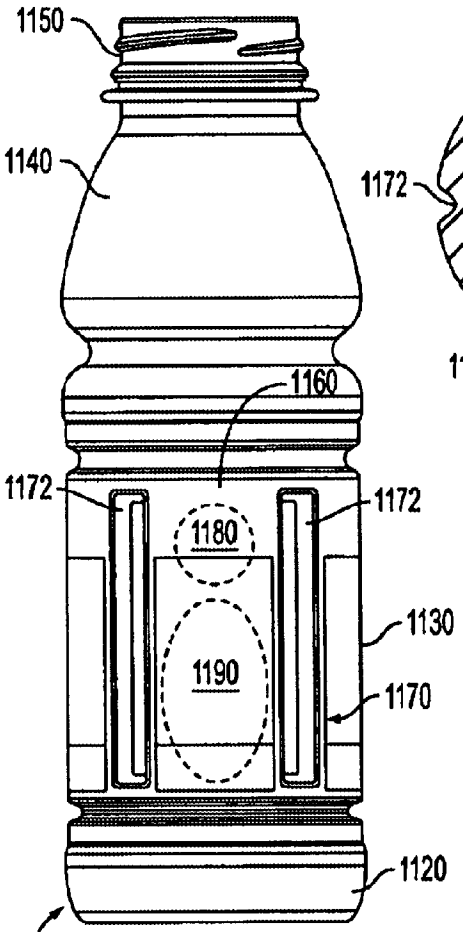
FIG. 12
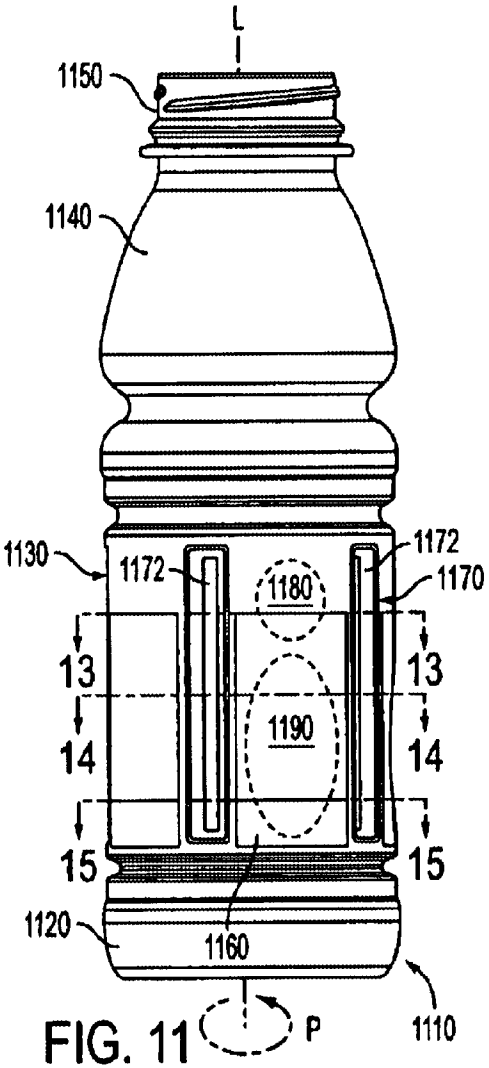
FIG. 11

PLASTIC CONTAINER HAVING AN INVERTED ACTIVE CAGE

CROSS-REFERENCE TO RELATED APPLICATIONS

This application is related to a provisional patent application Serial No. 60/305,620, filed Jul. 17, 2001 by Richard K. Go et al., entitled "Plastic Container", which is commonly assigned to the assignee of the present invention and incorporated herein by reference.

BACKGROUND OF THE INVENTION

1. Field of the Invention

The present invention generally relates to a pressure-adjustable container, and more particularly to such containers that are typically made of polyester and are capable of being filled with hot liquid. It also relates to an improved sidewall construction for such containers.

2. Statement of the Prior Art

"Hot-fill" applications impose significant and complex mechanical stress on the structure of a plastic container due to thermal stress, hydraulic pressure upon filling and immediately after capping the container, and vacuum pressure as the fluid cools.

Thermal stress is applied to the walls of the container upon introduction of hot fluid. The hot fluid causes the container walls to first soften and then shrink unevenly, causing distortion of the container. The plastic material (e.g., polyester) must, therefore, be heat-treated to induce molecular changes resulting in a container that exhibits thermal stability.

Pressure and stress also act upon the sidewalls of a heat resistant container during the filling process, and for a significant period of time thereafter. When the container is filled with hot fluid and sealed, there is an initial hydraulic pressure and an increased internal pressure is placed upon the container. As the liquid and the air headspace under the cap subsequently cools, thermal contraction results in partial evacuation of the container. The vacuum created by this cooling tends to mechanically deform the container walls.

Generally speaking, plastic containers incorporating a plurality of longitudinal fiat surfaces accommodate vacuum force more readily. For example, U.S. Pat. No. 4,497,855 (Agrawal et al.) discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure. Otherwise, such forces would deform the inflexible post or land area structures. The amount of "flex" available in each panel is limited, however. As that limit is approached, there is an increased amount of force that is transferred to the sidewalls.

To minimize the effect of force being transferred to the sidewalls, much prior art has focused on providing stiffened regions to the container, including the panels, to prevent the structure yielding to the vacuum force. For example, the provision of either horizontal or vertical annular sections, or "ribs", throughout a container has become common practice in container construction. The use of such ribs is not only restricted to hot-fill containers. Such annular sections strengthen the part upon which they are deployed.

Examples of the prior art teaching the use of such ribs are U.S. Pat. No. 4,372,455 ("Cochran"), U.S. Pat. No. 4,805, 788 ("Ota I"), U.S. Pat. No. 5,178,290 ("Ota II"), and U.S. Pat. No. 5,238,129 ("Ota III"). Cochran discloses annular rib strengthening in a longitudinal direction, placed in the areas between the flat surfaces that are subjected to inwardly deforming hydrostatic forces under vacuum force. Ota I discloses longitudinally extending ribs alongside the panels to add stiffening to the container, and the strengthening effect of providing a larger step in the sides of the land areas. This provides greater dimension and strength to the rib areas between the panels. Ota II discloses indentations to strengthen the panel areas themselves. Ota III discloses further annular rib strengthening, this time horizontally directed in strips above and below, and outside, the hot-fill panel section of the bottle.

In addition to the need for strengthening a container against both thermal and vacuum stress, there is a need to allow for an initial hydraulic pressure and increased internal pressure that is placed upon a container when hot liquid is first introduced and then followed by capping. This causes stress to be placed on the container sidewall. There is a forced outward movement of the heat panels, which can result in a barreling of the container.

Thus, U.S. Pat. No. 4,877,141 ("Hayashi et al.") discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

U.S. Pat. No. 5,908,128 ("Krishnakumar I") discloses another flexible panel that is intended to be reactive to hydraulic pressure and temperature forces that occur after filling. Relatively standard hot-fill style container geometry is disclosed for a "pasteurizable" container. It is claimed that the pasteurization process does not require the container to be heat-set prior to filling, because the liquid is introduced cold and is heated after capping. Concave panels are used to compensate for the pressure differentials. To provide for flexibility in both radial outward movement followed by radial inward movement however, the panels are kept to a shallow inward-bow to accommodate a response to the changing internal pressure and temperatures of the pasteurization process. The increase in temperature after capping, which is sustained for some time, softens the plastic material and therefore allows the inwardly curved panels to flex more easily under the induced force. It is disclosed that too much curvature would prevent this, however. Permanent deformation of the panels when forced into an opposite bow is avoided by the shallow setting of the bow, and also by the softening of the material under heat. The amount of force transmitted to the walls of the container is therefore once again determined by the amount of flex available in the panels, just as it is in a standard hot-fill bottle. The amount of flex is limited, however, due to the need to keep a shallow curvature on the radial profile of the panels. Accordingly, the bottle is strengthened in many standard ways.

U.S. Pat. No. 5,303,834 ("Krishnakumar II") discloses still further "flexible" panels that can be moved from a convex position to a concave position, in providing for a "squeezable" container. Vacuum pressure alone cannot invert the panels, but they can be manually forced into inversion. The panels automatically "bounce" back to their original shape upon release of squeeze pressure, as a significant amount of force is required to keep them in an inverted position, and this must be maintained manually. Permanent deformation of the panel, caused by the initial convex presentation, is avoided through the use of multiple longitudinal flex points.

U.S. Pat. No. 5,971,184 ("Krishnakumar III") discloses still further "flexible" panels that claim to be movable from a convex first position to a concave second position in providing for a grip-bottle comprising two large, flattened sides. Each panel incorporates an indented "invertible" central portion. Containers such as this, whereby there are two large and flat opposing sides, differ in vacuum pressure stability from hot-fill containers that are intended to maintain a generally cylindrical shape under vacuum draw. The enlarged panel sidewalls are subject to increased suction and are drawn into concavity more so than if each panel were smaller in size, as occurs in a "standard" configuration comprising six panels on a substantially cylindrical container. Thus, such a container structure increases the amount of force supplied to each of the two panels, thereby increasing the amount of flex force available.

Even so, the convex portion of the panels must still be kept relatively flat, however, or the vacuum force cannot draw the panels into the required concavity. The need to keep a shallow bow to allow flex to occur was previously described in both Krishnakumar I and Krishnakumar II. This, in turn, limits the amount of vacuum force that is vented before strain is placed on the container walls. Further, it is generally considered impossible for a shape that is convex in both the longitudinal and horizontal planes to successfully invert, anyhow, unless it is of very shallow convexity. Still further, the panels cannot then return back to their original convex position again upon release of vacuum pressure when the cap is removed if there is any meaningful amount of convexity in the panels. At best, a panel will be subject to being "force-flipped" and will lock into a new inverted position. The panel is then unable to reverse in direction as there is no longer the influence of heat from the liquid to soften the material and there is insufficient force available from the ambient pressure. Additionally, there is no longer assistance from the memory force that was available in the plastic prior to being flipped into a concave position. Krishnakumar I previously discloses the provision of longitudinal ribs to prevent such permanent deformation occurring when the panel arcs are flexed from a convex position to one of concavity. This same observation regarding permanent deformation is also disclosed in Krishnakumar II. Hayashi et al. also disclose the necessity of keeping panels relatively flat if they were to be flexed against their natural curve.

It is believed that the principal mode of failure in prior art containers is non-recoverable buckling of the structural geometry of the container, due to weakness, when there is a vacuum pressure inside the container. This is especially the case when such a container has been subjected to a lowering of the material weight for commercial advantage.

One means of avoiding such modes of failure is disclosed in International Publication No. WO 00/50309 ("Melrose"). Melrose discloses a container having pressure responsive panels that allow for increased flexing of the vacuum panel sidewalls so that the pressure on the containers may be more readily accommodated. Reinforcing ribs of various types and location may still be used, as described above, to still compensate for any excess stress that must inevitably be present from the flexing of the container walls into the new "pressure-adjusted" condition by ambient forces.

Containers of the type disclosed in Melrose are known as "active cage" containers. Active cage refers to a type of high-uptake vacuum flex panel that can be smaller in size, that does not need to be encased in a traditional rigid frame, and that can be located nearly anywhere on the outer surfaces of the bottle. Such surfaces are also known as active surfaces. The vacuum flex panels according to Melrose are set inwardly with respect to the longitudinal axis of the container, and are located between relatively inflexible land areas. Preferably, the container includes a connecting portion between the flexible panel and inflexible land areas.

The connector portions are adapted to locate the flexible panel and land areas at a different circumference relative to a center of the container. In a preferred embodiment, the connecting portion is substantially "U"-shaped, wherein the side of the connecting portion towards the flexible panel is adapted to flex, substantially straightening the "U"-shape when the flexible panel is in a first position and return to the "U"-shape when the flexible panel is inverted from the first position. Such connecting portions and land areas form a network of pillars, each of which are set outwardly with respect to the longitudinal axis of the container. The plurality of active surfaces, together with the network of pillars, are spaced about the periphery of the container in order to accommodate vacuum-induced volumetric shrinkage of the container resulting from a hot-filling, capping and cooling thereof.

It has been found that an "inverted active cage" would not only provide further freedom in the aesthetic design and ornamental appearance of plastic containers, but would also accommodate such vacuum-induced volumetric shrinkage of those containers. Accordingly, it would be desirable to provide a container with a plurality of active surfaces, each of which is outwardly displaced with respect to the longitudinal axis of the container, and a network of pillars, each of which is inwardly displaced with respect to the longitudinal axis of the container. Such a plurality of active surfaces together with the network of pillars could, thus, be spaced about the periphery of the container for accommodating vacuum-induced volumetric shrinkage of the container resulting from a hot-filling, capping and cooling thereof.

SUMMARY OF THE INVENTION

A container having an inverted active cage achieves the above and other objects, advantages, and novel features according to the present invention.

Such a container generally comprises an enclosed base portion, a body portion extending upwardly from the base portion, and a top portion with a finish extending upwardly from the body portion. The body portion includes a central longitudinal axis, a periphery, a plurality of active surfaces, and a network of pillars. Importantly, each of the plurality of active surfaces is outwardly displaced with respect to the longitudinal axis, while each of the network of pillars is inwardly displaced with respect to the longitudinal axis. The plurality of active surfaces, together with the network of pillars, are spaced about the periphery for accommodating vacuum-induced volumetric shrinkage of the container resulting from a hot-filling, capping and cooling thereof.

The body portion may suitably comprise a hollow body formed generally in the shape of a cylinder. As a result, a cross-section of that body in a plane perpendicular to the longitudinal axis may comprise a circle, an ellipse, or an oval.

Alternatively, the body portion may suitably comprise a hollow body formed generally in the shape of a polyhedron (i.e., a solid bounded by planar polygons). In those instances where the body portion is formed generally in the shape of a polyhedron, such shape may more specifically be a parallelepiped (i.e., a polyhedron all of whose faces are parallelograms).

According to one aspect of the present invention, there is provided two or more controlled deflection flex panels, each of which has an initiator region of a predetermined extent of projection and a flexure region of a greater extent of projection extending away from the initiator region. As a result, flex panel deflection occurs in a controlled manner in response to changing container pressure. Each of the plurality of active surfaces, thus, comprises a controlled deflection flex panel or vacuum flex panel.

According to another aspect of the present invention, the body portion comprises two or more vacuum flex panels. In various embodiments as shown as described herein, the body portion comprises three, five, six, and twelve such vacuum flex panels.

The network of pillars of the present invention preferably comprises one or more grooves separating each of the plurality of active surfaces. Each groove extends substantially between the top portion and the base portion. In one embodiment, a top portion of each groove is displaced from a bottom portion thereof by approximately sixty degrees around the periphery of the container. A portion of each of the plurality of active surfaces, thus, extends by approximately one-third around the periphery of the container. According to yet another aspect of the present invention, the plurality of active surfaces and network of pillars together comprise an active cage. Such an active cage may comprise a substantially rigid cage or a substantially flexible cage.

In one embodiment, the network of pillars comprises a substantially sinusoidal-shaped groove extending about the periphery of the container. That groove extends substantially between the top portion and the base portion.

Each of the plurality of active surfaces, as noted above, further comprises an initiator portion and a flexure portion. The initiator portion and the flexure portion are preferably positioned substantially parallel to and in the direction of the longitudinal axis within each of the plurality of active surfaces.

The network of pillars may also comprise an annulus. In one embodiment, the annulus comprises a substantially sinusoidal-shaped groove extending about the periphery of the container. In this embodiment, at least one of the initiator portions is positioned above the substantially sinusoidal-shaped groove and at least another of the initiator portions is positioned below the substantially sinusoidal-shaped groove.

Alternatively, the network of pillars may comprise a plurality of grooves positioned substantially parallel to and in the direction of the longitudinal axis within each of the plurality of active surfaces. The network of pillars in this embodiment may also comprise an annulus. Such an annulus may comprise a substantially sinusoidal-shaped groove extending about the periphery of the container. In this embodiment as well, each of the plurality of active surfaces may further comprise an initiator portion and a flexure portion. The initiator portion and the flexure portion are positioned substantially parallel to and in the direction of the longitudinal axis within each of the plurality of active surfaces.

At least one of the initiator portions is positioned above the substantially sinusoidal-shaped groove and at least another of the initiator portions is positioned below the substantially sinusoidal-shaped groove.

In a container having an enclosed base portion, a body portion extending upwardly from the base portion and including an active cage that is adapted to accommodate vacuum-induced volumetric shrinkage of the container resulting from a hot-filling, capping and cooling thereof, and a top portion with a finish extending upwardly from the body portion, the present invention also provides an improvement comprising inverting the active cage.

In a container having an enclosed base portion, a body portion extending upwardly from the base portion, and a top portion with a finish extending upwardly from the body portion, wherein the body portion includes a periphery and an active cage disposed about the periphery to accommodate vacuum-induced volumetric shrinkage of the container resulting from a hot-filling, capping and cooling thereof, the present invention further provides the improvement comprising inverting the active cage.

An active cage for a plastic container having a central longitudinal axis and a periphery, in accordance with the oresent invention, comprises a plurality of active surfaces; and a network of pillars; wherein, with respect to the longitudinal axis, each of the plurality of active surfaces is outwardly displaced and each of the network of pillars is inwardly displaced, and the plurality of active surfaces together with the network of pillars are spaced about the periphery for accommodating vacuum-induced volumetric shrinkage of the container resulting from a hot-filling, capping and cooling thereof.

Also disclosed is an inverted active cage for a plastic container, which comprises a plurality of active surfaces, each of which is outwardly displaced with respect to a longitudinal axis of the container; and a network of pillars, each of which is inwardly displaced with respect to the longitudinal axis. The inverted active cage according to the present invention spaces the plurality of active surfaces together with the network of pillars about the periphery of the container in order to accommodate vacuum-induced volumetric shrinkage of the container resulting from a hot-filling, capping and cooling thereof. The inverted active cage may also comprise an annulus, and the annulus may comprise a waist.

The foregoing and other features and advantages of the invention will become more apparent from the following detailed description of exemplary embodiments thereof, when consider in conjunction with the accompanying drawings wherein:

BRIEF DESCRIPTION OF THE DRAWINGS

FIG. 8 illustrates a sectional view of the container shown in FIG. 7, taken along the lines 8—8;

FIG. 11 illustrates an elevational view of a container according to a fourth embodiment of the present invention;

FIG. 12 illustrates an elevational view of the container shown in FIG. 11, rotated about its longitudinal axis approximately 90°;

FIG. 13 illustrates a sectional view of the container shown in FIG. 11, taken along the lines 13—13;

FIG. 14 illustrates a sectional view of the container shown in FIG. 11, taken along the lines 14—14;

FIG. 15 illustrates a sectional view of the container shown in FIG. 11, taken along the lines 15—15;

DETAILED DESCRIPTION OF THE INVENTION

Figure 1:
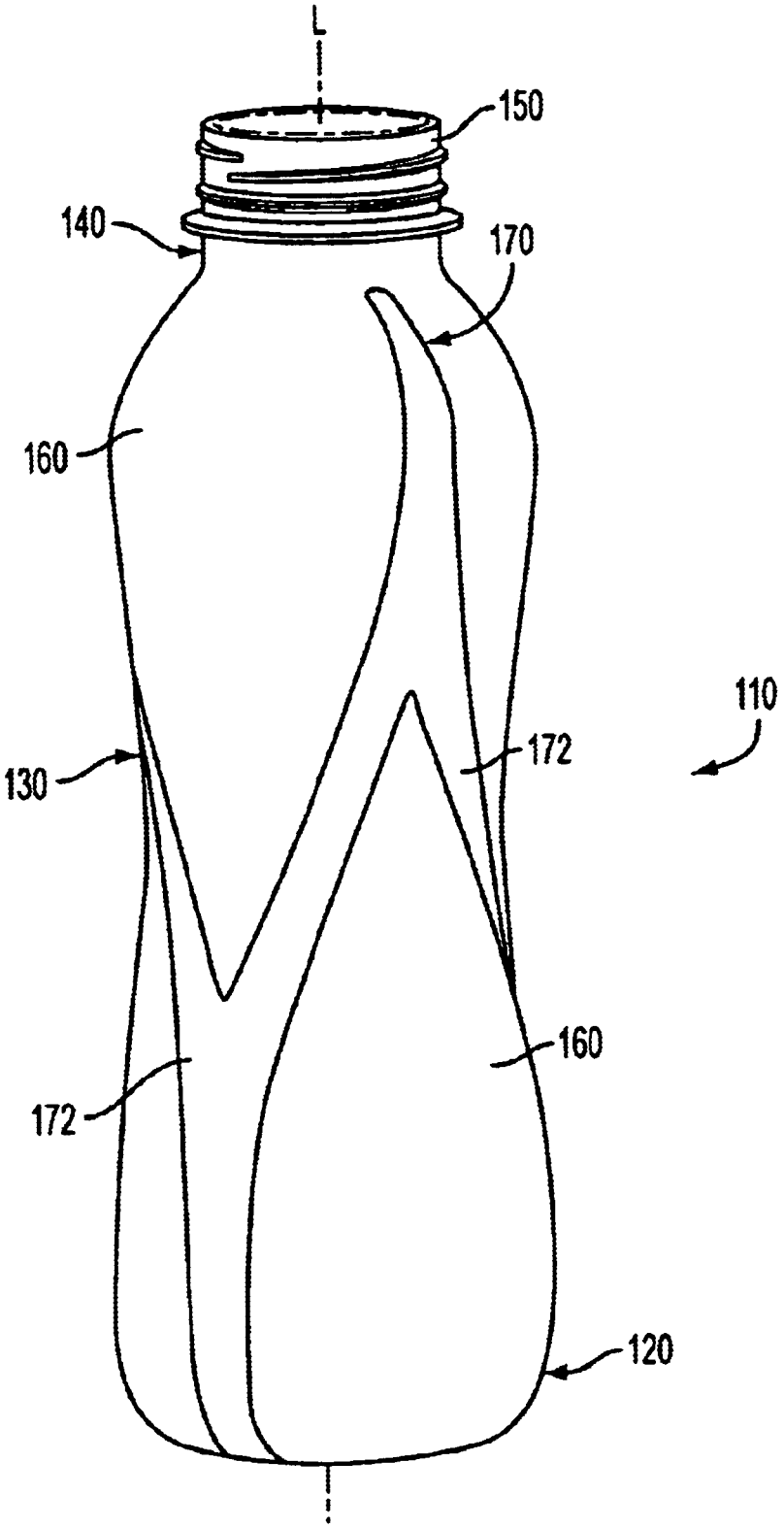
FIG. 1 illustrates an orthogonal view of a container according to a first embodiment of the present invention.
Figure 2:
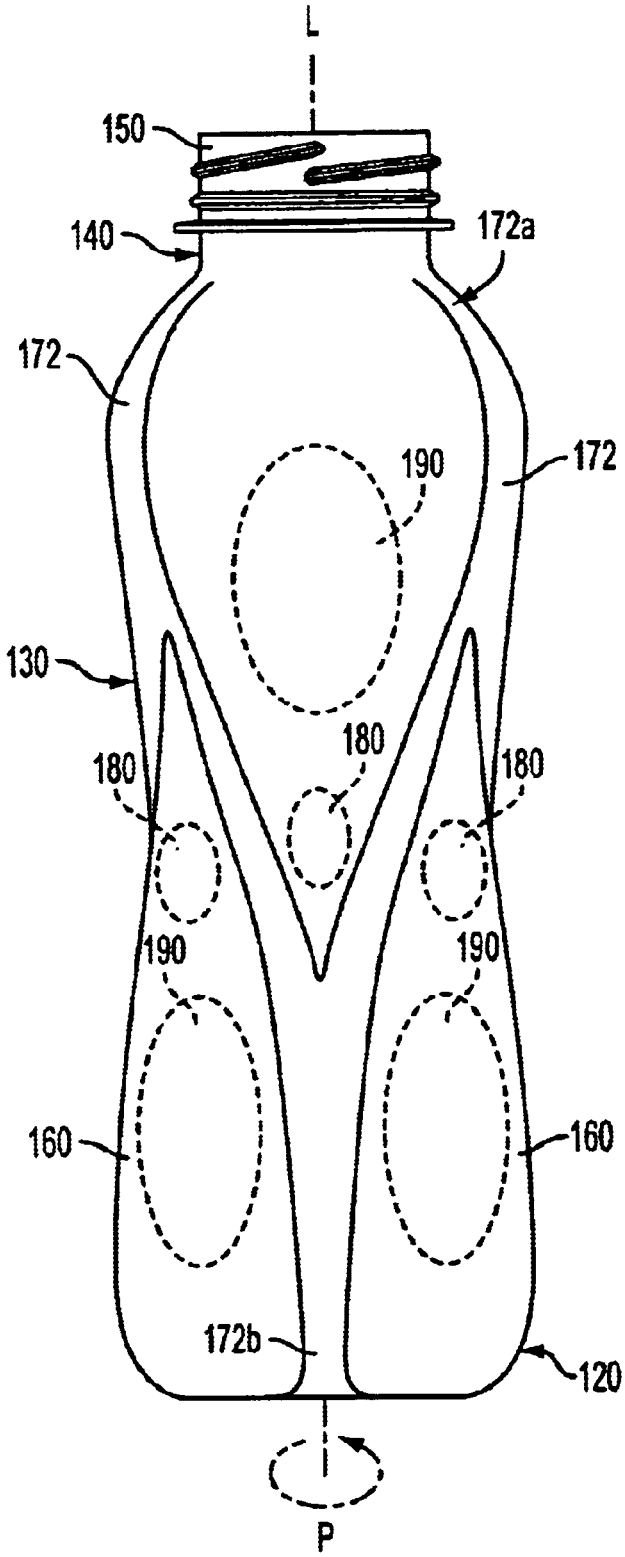
FIG. 2 illustrates an elevational view of the container shown in FIG. 1, rotated about its longitudinal axis approximately 60°.

Referring now to the drawings, wherein like reference characters or numbers represent like or corresponding parts throughout each of the several views, there is shown in FIG. 1 an orthogonal view of a container 110 according to a first embodiment of the present invention. Container 110 (an elevational view of which is also shown in FIG. 2, rotated about its longitudinal axis L by approximately 90°) generally comprises an enclosed base portion 120, a body portion 130 extending upwardly from the base portion 120, and a top portion 140 with a finish 150 extending upwardly from the body portion 130. Body portion 130 includes the central longitudinal axis L, a periphery P, a plurality of active surfaces 160, and a network of pillars 170. Importantly, each of the plurality of active surfaces 160 is outwardly displaced with respect to the longitudinal axis L, while each of the network of pillars 170 is inwardly displaced with respect to the longitudinal axis L. The plurality of active surfaces 160, together with the network of pillars 170, are spaced about the periphery P of the container 110 in order to accommodate vacuum-induced volumetric shrinkage of the container 110 resulting from a hot-filling, capping and cooling thereof.

Figure 9:
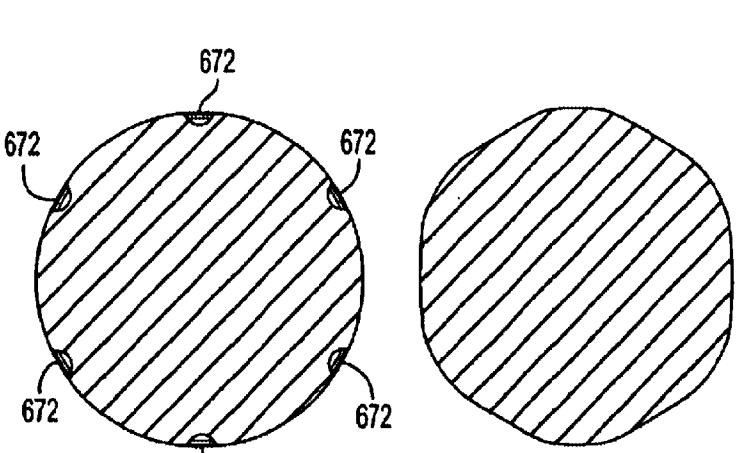
FIG. 9 illustrates a sectional view of the container shown in FIG. 7, taken along the lines 9—9.
Figure 10:
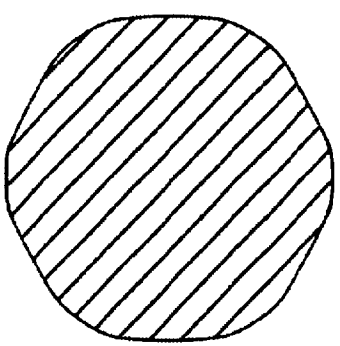
FIG. 10 illustrates a sectional view of the container shown in FIG. 7, taken along the lines 10—10.
Figure 20:
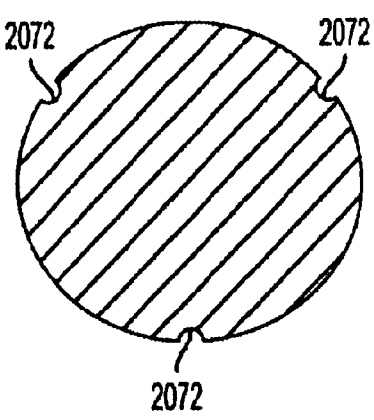
FIG. 20 illustrates a sectional view of a container, similar to the one shown in FIG. 11 except that it has an elliptical cross-section, taken along lines corresponding to lines 13—13.
Figure 21:
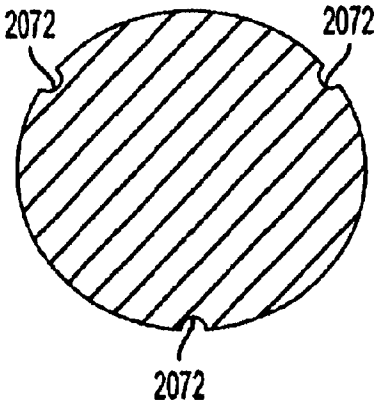
FIG. 21 illustrates a sectional view of a container, similar to the one shown in FIG. 11 except that it has an elliptical cross-section, taken along lines corresponding to lines 14—14.
Figure 22:
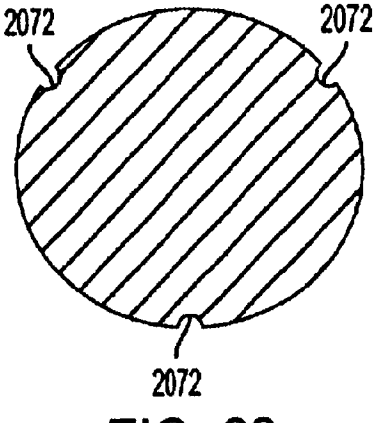
FIG. 22 illustrates a sectional view of a container, similar to the one shown in FIG. 11 except that it has an elliptical cross-section, taken along lines corresponding to lines 15—15.
Figure 23:
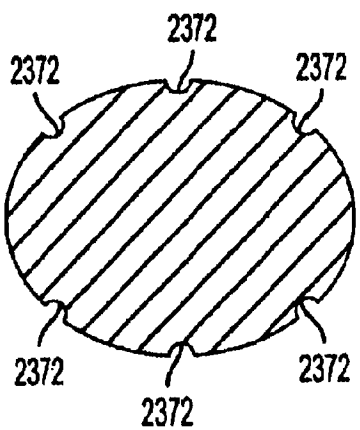
FIG. 23 illustrates a sectional view of a container, similar to the one shown in FIG. 11 except that it has an oval cross-section, taken along lines corresponding to lines 13—13.
Figure 24:
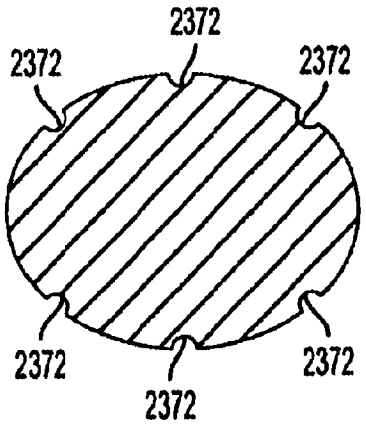
FIG. 24 illustrates a sectional view of a container, similar to the one shown in FIG. 11 except that it has an oval cross-section, taken along lines conesponding to lines 14—14.
Figure 25:
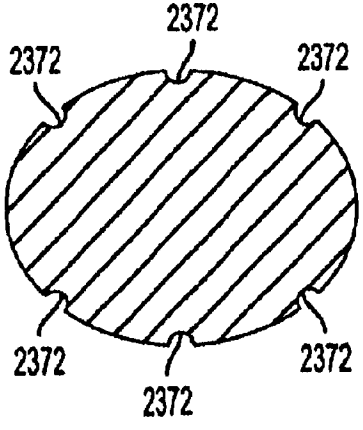
FIG. 25 illustrates a sectional view of a container, similar to the one shown in FIG. 11 except that it has an oval cross-section, taken along lines corresponding to lines 15—15.

The body portion 130 may suitably comprise a hollow body formed generally in the shape of a cylinder. As a result, a cross-section of that body in a plane perpendicular to the longitudinal axis may comprise a circle (see, e.g. FIGS. 8 and 13–15), although a body having a cross-section in the form of an ellipse (see.e.g. FIGS. 20–22), or an oval (see, e.g., FIGS. 23–25), would not depart from the true spirit and scope of the present invention. Alternatively, the body portion 130 may suitably comprise a hollow body formed generally in the shape of a polyhedron (i.e., a solid bounded by planar polygons). In those instances where the body portion is formed generally in the shape of a polyhedron, such shape may more specifically be a parallelepiped (i.e., a polyhedron all of whose faces are parallelograms). FIGS. 9 and 10 are but one example of such a body portion 130, which comprises a hollow body having a cross-section of a hexagon. However, the disclosure herein should in no way be construed as limiting the cross-section of such body portions 130 to hexagons. Cross-sections of a generally triangular, square, rectangular, pentagonal, octagonal, etc. are well within the true spirit and scope of the present invention, so long as they incorporate the inverted active cage disclosed herein.

According to one aspect of the present invention, there is provided in the container 110 shown in FIGS. 1 and 2, two or more controlled deflection flex panels 160, each of which has an initiator region 180 of a predetermined extent of projection and a flexure region 190 of a greater extent of projection extending away from the initiator region. As a result, flex panel deflection occurs in a controlled manner in response to changing container pressure. Each of the plurality of active surfaces 160, thus, comprises a controlled deflection flex panel or vacuum flex panel. Thus, the body portion 130 comprises two or more vacuum flex panels. In various embodiments as shown as described herein, the body portion comprises five (FIGS. 11–15), six (FIGS. 1–5), and twelve (FIGS. 6–10) such vacuum flex panels.

The network of pillars 170 of the present invention preferably comprises one or more grooves 172 separating each of the plurality of active surfaces 160. Each groove 172, according to the embodiment shown in FIGS. 1 and 2, extends substantially between the top portion 140 and the base portion 120. In this same embodiment, a top portion 172*a* of each groove is displaced from a bottom portion 172*b* thereof by approximately sixty degrees around the periphery P of the container 110. A portion of each of the plurality of active surfaces 160, thus, extends by approximately one-third around the periphery P of the container 110. According to yet another aspect of the present invention, the plurality of active surfaces 160 and network of pillars 170 together comprise an active cage. Such an active cage may comprise a substantially rigid cage or a substantially flexible cage.

Figure 4:
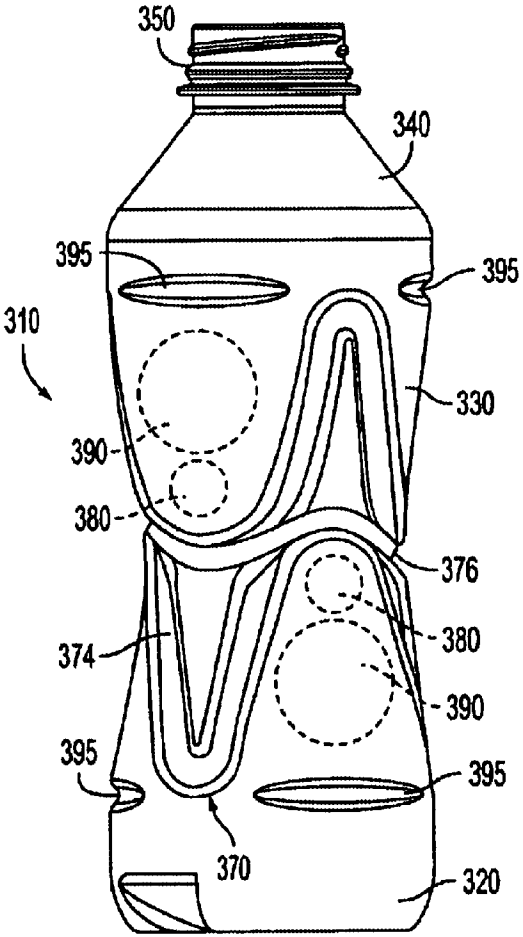
FIG. 4 illustrates an elevational view of the container shown in FIG. 3, rotated about its longitudinal axis approximately 90°.
Figure 3:
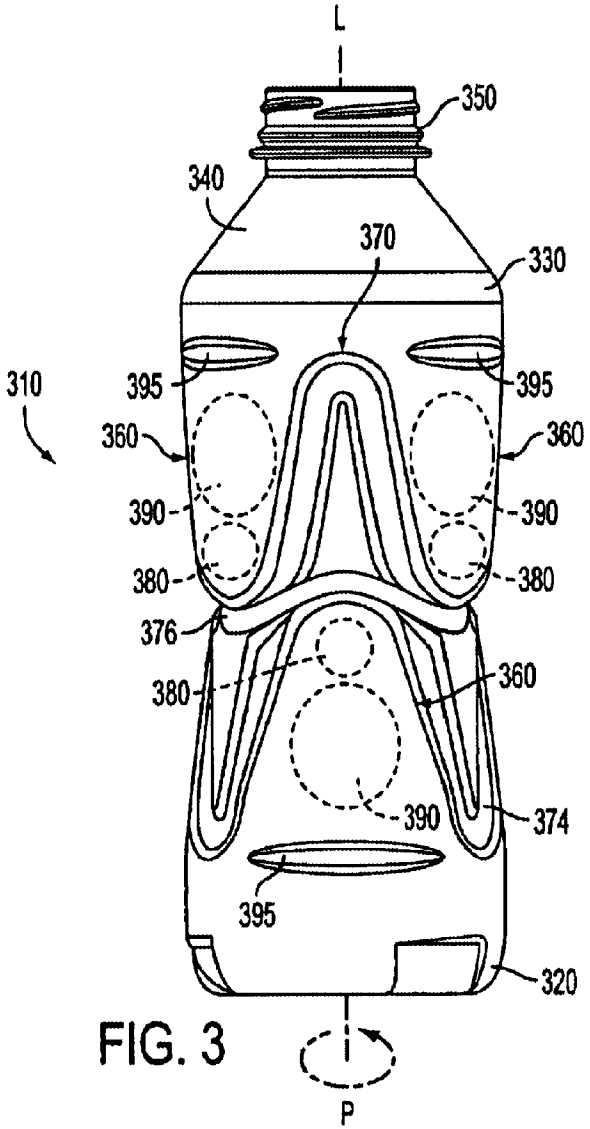
FIG. 3 illustrates an elevational view of a container according to a second embodiment of the present invention.

In the embodiment shown in FIGS. 3 and 4, the network of pillars 370 preferably comprises a substantially sinusoidal-shaped groove 374, which extends about the periphery P of the container 310. That groove 374 extends substantially between the top portion 340 and the base portion 320 of container 310.

Each of the plurality of active surfaces 360 shown in FIGS. 3 and 4, as noted above, further comprises an initiator portion 380 and a flexure portion 390. The initiator portion 380 and the flexure portion 390 are preferably positioned substantially parallel to and in the direction of the longitudinal axis L within each of the plurality of active surfaces 360. It should be noted at this juncture that, with a "waisted" design as shown in FIGS. 3 and 4, one end of each of the plurality of active surfaces 360 is slightly more outwardly displaced than its other end. As a result, this creates an inwardly tapered silhouette more or less through the middle of the container 310, where an annulus 376 has a smaller diameter than at the top and bottom of the active cage.

Figure 5:
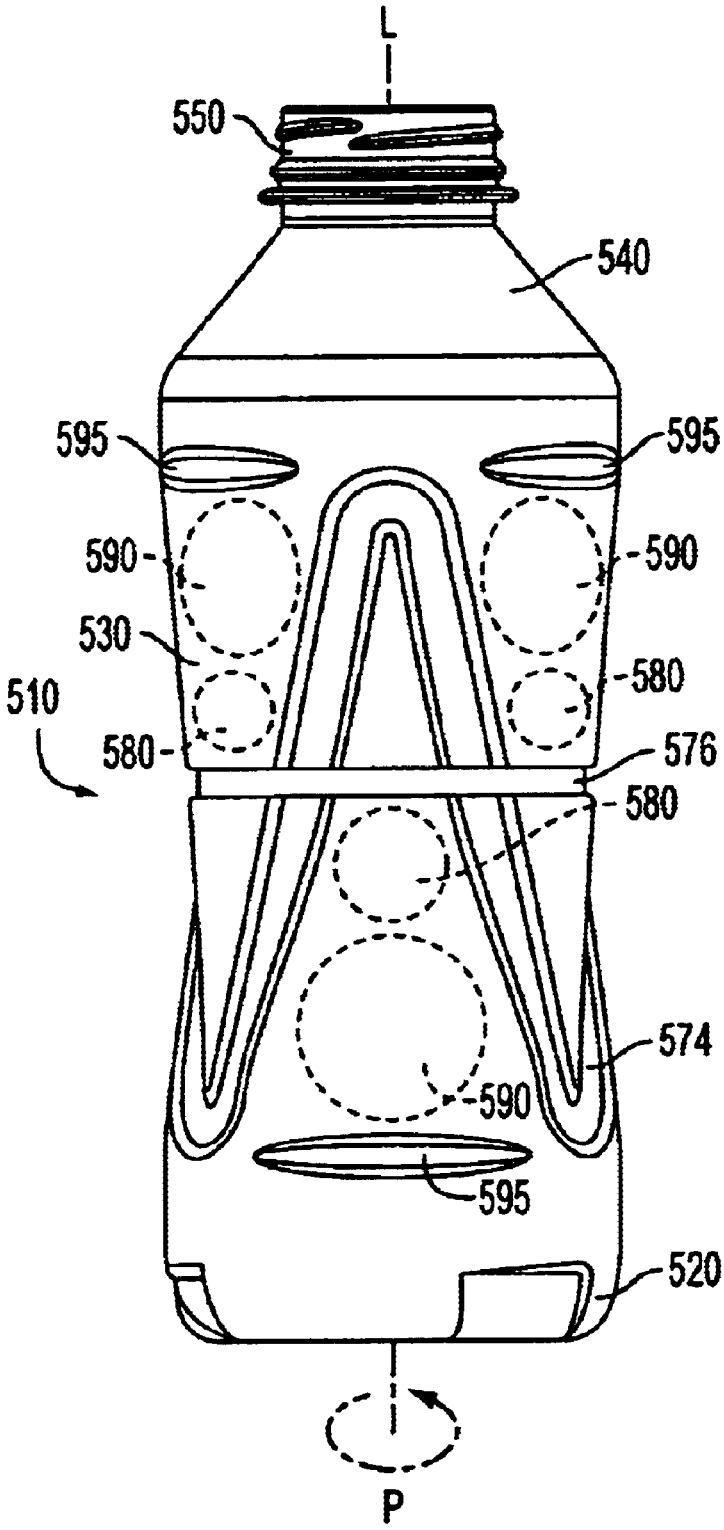
FIG. 5 illustrates an elevational view of a container according to a third embodiment of the present invention.

The network of pillars 370 may, thus, also comprise the annulus 376. In the embodiment shown in FIGS. 3 and 4, the annulus 376 comprises a substantially sinusoidal-shaped groove extending about the periphery P of the container 310. In this embodiment, at least one of the initiator portions 380 is positioned above the substantially sinusoidal-shaped groove comprising the annulus 376 and at least another of the initiator portions 380 is positioned below that groove. The groove may, in the alternative, comprise a substantially straight annulus 576 as shown in FIG. 5. It should be noted at this juncture that a network of pillars, which includes an annulus as described herein, may comprise an annulus of many shapes and sizes without departing from the true spirit and scope of the present invention.

Figure 7:
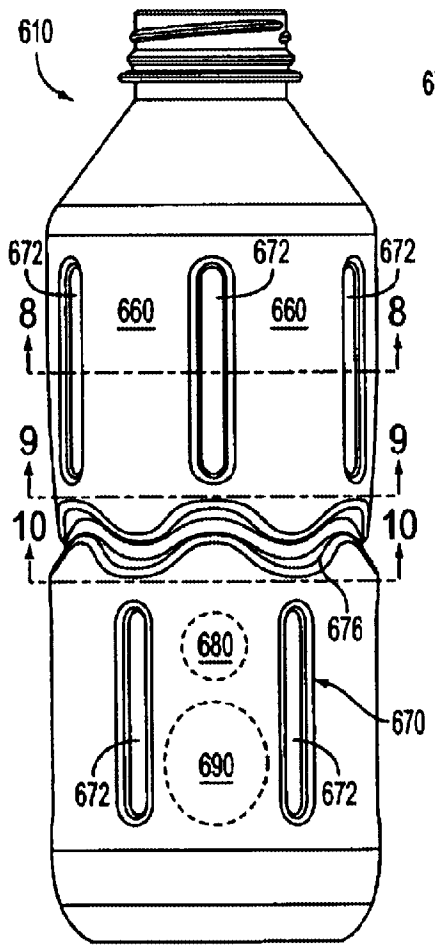
FIG. 7 illustrates an elevational view of the container shown in FIG. 6, rotated about its longitudinal axis approximately 90°.
Figure 6:
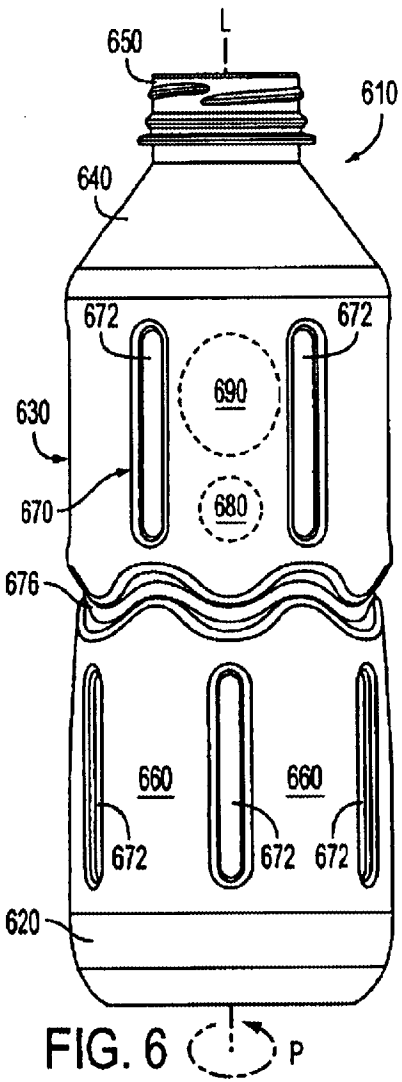
FIG. 6 illustrates an elevational view of a container according to a fourth embodiment of the present invention.

Alternatively, and referring now to FIGS. 6–10, the network of pillars 670 may comprise a plurality of grooves 672 positioned substantially parallel to and in the direction of the longitudinal axis L within each of the plurality of active surfaces 660. The network of pillars 670 in this embodiment may also comprise an annulus 676. Such an annulus 676 may comprise a substantially sinusoidal-shaped groove, as shown in FIGS. 6 and 7, which extends about the periphery P of the container 610. In this embodiment as well, each of the plurality of active surfaces 660 may further comprise an initiator portion 680 and a flexure portion 690. The initiator portion 680 and the flexure portion 690 are positioned substantially parallel to and in the direction of the longitudinal axis L within each of the plurality of active surfaces 660. At least one of the initiator portions 680 is also positioned above the substantially sinusoidal-shaped groove comprising the annulus 676, while at least another of the initiator portions 680 is positioned below that groove.

Alternatively, and referring now to FIGS. 11–15, the network of pillars 1170 may comprise a plurality of grooves 1172 positioned substantially parallel to and in the direction of the longitudinal axis L within each of the plurality of active surfaces 1160. The network of pillars 1170 in this embodiment may also comprise an annulus (not shown). In this embodiment as well, each of the plurality of active surfaces 1160 may further comprise an initiator portion 1180 and a flexure portion 1190. The plurality of grooves 1172 each extend inwardly with respect to the longitudinal axis L of the container 1110, while the plurality of active surfaces 1160 extend outwardly with respect to that longitudinal axis L.

Figure 16:
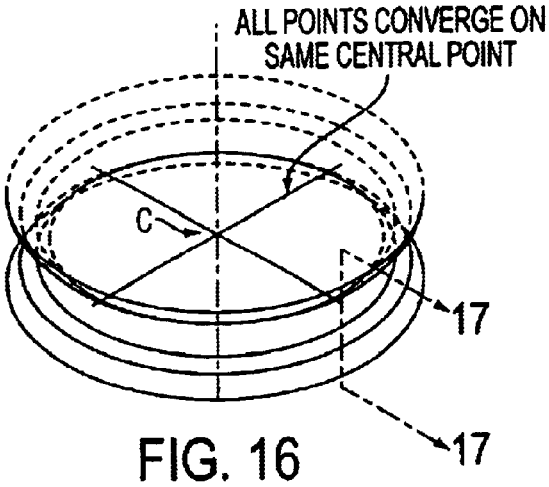
FIG. 16 illustrates in greater detail and in isolation the annulus shown in FIG. 5.
Figure 17:
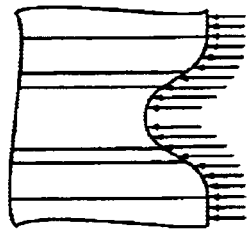
FIG. 17 illustrates the stresses occurring along the lines 17—17 in FIG. 16.
Figure 18:
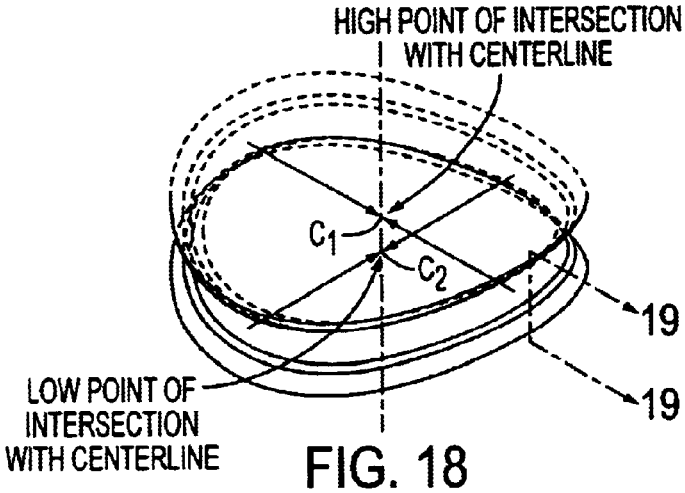
FIG. 18 illustrates in greater detail and in isolation the annulus shown in FIGS. 3–4 and 6–7.
Figure 19:
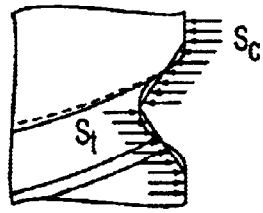
FIG. 19 illustrates the stresses occurring along the lines 19—19 in FIG. 18.

Referring now to FIGS. 16–19, a further description of the stresses impact the annulus 376, 576, and 676 will now be described. FIG. 16 illustrates in greater detail and in isolation the annulus 576 shown in FIG. 5. The groove forming annulus 576, in resisting the pull of internal forces, is placed in a state of compressive stress (see, e.g., FIG. 17). This is because the entire portion of that groove is located in a single plane and all of the forces pass through a common central point C (FIG. 16). On the other hand, the substantially sinusoidal-shaped annulus 376, 676 that is shown in FIGS. 3–4 and 6–7 is not in one plane so that the loads resulting from the vacuum do not pass though a single point (see, e.g., points $C_1$ and $C_2$ in FIG. 18). It is believed that these non-coplanar forces create a bending moment that must be resisted by tension and compressive stresses (see, e.g., stresses $S_t$ and $S_c$ in FIG. 19) in the grooves forming the substantially sinusoidal-shaped annulus 376, 676. These additional stresses increase the deflection of the grooves forming the substantially sinusoidal-shaped annulus 376, 676 so that they become more flexible. It is believed that this enhanced flexability can be taken advantage of in the design of containers to accommodate internal volume change.

In a container 110, 310, 510, 610, 1110 having an enclosed base portion 120, 320, 520, 620, 1120, a body portion 130, 330, 530, 630, 1130 extending upwardly from the base portion 120, 320, 520, 620, 1120 and including an active cage that is adapted to accommodate vacuum-induced volumetric shrinkage of the container resulting from a hot-filling, capping and cooling thereof, and a top portion 140, 340, 540, 640, 1140 with a finish 150, 350, 550, 650, 1150 extending upwardly from the body portion, the present invention also provides a simple, yet elegant improvement of inverting the active cage.

In a container 110, 310, 510, 610, 1110 having an enclosed base portion 120, 320, 520, 620, 1120, a body portion 130, 330, 530, 630, 1130 extending upwardly from the base portion 120, 320, 520, 620, 1120, and a top portion 140, 340, 540, 640, 1140 with a finish 150, 350, 550, 650, 1150 extending upwardly from the body portion 130, 330, 530, 630, 1130, wherein the body portion 130, 330, 530, 630, 1130 includes a periphery P and an active cage disposed about the periphery P to accommodate vacuum-induced volumetric shrinkage of the container 110, 310, 510, 610, 1110 resulting from a hot-filling, capping and cooling thereof, the present invention further provides the improvement of inverting the active cage.

As demonstrated herein before, an active cage for a plastic container 110, 310, 510, 610, 1110 having a central longitudinal axis L and a periphery P, comprises a plurality of active surfaces 160, 360, 560, 660, 1160, and a network of pillars 170, 370, 570, 670, 1170. With respect to the longitudinal axis L, each of the plurality of active surfaces is outwardly displaced 160, 360, 560, 660, 1160 and each of the network of pillars 170, 370, 570, 670, 1170 is inwardly displaced. The plurality of active surfaces 160, 360, 560, 660, 1160 together with the network of pillars 170, 370, 570, 670, 1170 are, thus, spaced about the periphery P for accommodating vacuum-induced volumetric shrinkage of the container 110, 310, 510, 610,1110 resulting from a hot-filling, capping and cooling thereof.

Also disclosed has been an inverted active cage for a plastic container 110, 310, 510, 610, 1110, which comprises a plurality of active surfaces 160, 360, 560, 660, 1160, each of which is outwardly displaced with respect to a longitudinal axis L of the container 110, 310, 510, 610, 1110, and a network of pillars 170, 370, 570, 670, 1170, each of which is inwardly displaced with respect to the longitudinal axis L. The inverted active cage according to the present invention, thus, spaces the plurality of active surfaces 160, 360, 560, 660, 1160 together with the network of pillars 170, 370, 570, 670, 1170 about the periphery P of the container 110, 310, 510, 610, 1110 in order to accommodate vacuum-induced volumetric shrinkage of the container resulting from a hot-filling, capping and cooling thereof. Furthermore, the inverted active cage of the present invention may also comprise an annulus 376, 576, 676, and the annulus 376,

576, 676 may comprise a "waist" portion of the container 110, 310, 510, 610, 1110.

Various modifications of the containers, improvements, and active cages disclosed herein above are possible without departing from the true spirit and scope of the present invention. For example, reinforcing ribs 395 (FIGS. 3–4), 595 (FIG. 5) of various types and location may still be used, as described above, to still compensate for any excess stress that must inevitably be present from the flexing of the container walls into the new "pressure-adjusted" condition by ambient forces. It should, therefore, be understood that within the scope of the following claims, the present invention may be practiced otherwise than as has been specifically described in the foregoing embodiments.

What is claimed as our invention is:

1. A blow-molded plastic container, comprising:

an enclosed base portion;

a body portion extending upwardly from said base portion, said body portion including a central longitudinal axis, a periphery, a plurality of active surfaces, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof, wherein said body portion comprises a hollow body formed generally in the shape of a cylinder and, wherein a cross-section of said body in a plane perpendicular to said longitudinal axis comprises an ellipse.

2. A blow-molded plastic container, comprising:

an enclosed base portion;

a body portion extending upwardly from said base portion, said body portion including a central longitudinal axis, a periphery, a plurality of active surfaces, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof, wherein said body portion comprises a hollow body formed generally in the shape of a cylinder and, wherein a cross-section of said body in a plane perpendicular to said longitudinal axis comprises an oval.

3. A blow-molded plastic container, comprising:

an enclosed base portion;

a body portion extending upwardly from said base portion, said body portion including a central longitudinal axis, a periphery, a plurality of active surfaces, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said body portion comprises a hollow body formed generally in the shape of a polyhedron.

4. The container according to claim 3, wherein said body portion comprises a hollow body formed generally in the shape of a parallelepiped.

5. A blow-molded plastic container, comprising:

an enclosed base portion;

a body portion extending upwardly from said base portion, said body portion including a central longitudinal axis, a periphery, a plurality of active surfaces, wherein each of said plurality of active surfaces comprises a vacuum flex panel, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said body portion comprises three vacuum flex panels.

6. A blow-molded plastic container, comprising:

an enclosed base portion;

a body portion extending upwardly from said base portion, said body portion including a central longitudinal axis, a periphery, a plurality of active surfaces, wherein each of said plurality of active surfaces comprises a vacuum flex panel, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said body portion comprises five vacuum flex panels.

7. A blow-molded plastic container, comprising:

an enclosed base portion;

a body portion extending upwardly from said base portion, said body portion including a central longitudinal axis, a periphery, a plurality of active surfaces, wherein each of said plurality of active surfaces comprises a vacuum flex panel, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said body portion comprises six vacuum flex panels.

8. A blow-molded plastic container, comprising:

an enclosed base portion;

a body portion extending upwardly from said base portion, said body portion including a central longitudinal axis, a periphery, a plurality of active surfaces, wherein each of said plurality of active surfaces comprises a vacuum flex panel, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said body portion comprises twelve vacuum flex panels.

9. A blow-molded plastic container, comprising:

an enclosed base portion;

a body portion extending upwardly from said base portion, said body portion including a central longitudinal axis, a periphery, a plurality of active surfaces, and a network of pillars, wherein said network of pillars comprises one or more grooves separating each of said plurality of active surfaces; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein each said groove extends substantially between said top portion and said base portion.

10. The container according to claim 9, wherein a top portion of each said groove is displaced from a bottom portion thereof by approximately sixty degrees around said periphery of the container.

11. A blow-molded plastic container, comprising:

an enclosed base portion;

a body portion extending upwardly from said base portion, said body portion including a central longitudinal axis, a periphery, a plurality of active surfaces, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein a portion of each of said plurality of active surfaces extends by approximately one-third around said periphery of the container.

12. A blow-molded plastic container, comprising:

an enclosed base portion;

a body portion extending upwardly from said base portion, said body portion including a central longitudinal axis, a periphery, a plurality of active surfaces, and a network of pillars, wherein said plurality of active surfaces and said network of pillars together comprise an active cage; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof, wherein said active cage comprises a substantially rigid cage.

13. A blow-molded plastic container, comprising:

an enclosed base portion;

a body portion extending upwardly from said base portion, said body portion including a central longitudinal axis, a periphery, a plurality of active surfaces, and a network of pillars, wherein said plurality of active surfaces and said network of pillars together comprise an active cage, wherein said active cage comprises a substantially flexible cage; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said network of pillars comprises a substantially sinusoidal-shaped groove extending about said periphery of the container.

14. The container according to claim 13, wherein said groove extends substantially between said top portion and said base portion.

15. The container according to claim 13, wherein each of said plurality of active surfaces further comprises an initiator portion and a flexure portion.

16. The container according to claim 15, wherein said initiator portion and said flexure portion are positioned substantially parallel to and in the direction of said longitudinal axis within each of said plurality of active surfaces.

17. A blow-molded plastic container, comprising:

an enclosed base portion;

a body portion extending upwardly from said base portion, said body portion including a central longitudinal axis, a periphery, a plurality of active surfaces, and a network of pillars; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said annulus comprises a substantially sinusoidal-shaped groove extending about said periphery of the container.

18. The container according to claim 17, wherein each of said plurality of active surfaces further comprises an initiator portion and a flexure portion.

19. The container according to claim 18, wherein said initiator portion and said flexure portion are positioned substantially parallel to and in the direction of said longitudinal axis within each of said plurality of active surfaces.

20. The container according to claim 19, wherein at least one of said initiator portions is positioned above said substantially sinusoidal-shaped groove and at least another of said initiator portions is positioned below said substantially sinusoidal-shaped groove.

21. A blow-molded plastic container, comprising:

an enclosed base portion;

a body portion extending upwardly from said base portion, said body portion including a central longitudinal axis, a periphery, a plurality of active surfaces, and a network of pillars, wherein said network of pillars comprises a plurality of grooves positioned substantially parallel to and in the direction of said longitudinal axis within each of said plurality of active surfaces, and wherein said network of pillars further comprises an annulus; and a top portion with a finish extending upwardly from said body portion;

wherein, with respect to said longitudinal axis, each of said plurality of active surfaces is outwardly displaced and each of said network of pillars is inwardly displaced, and said plurality of active surfaces together with said network of pillars are spaced about said periphery for accommodating vacuum-induced volumetric shrinkage of the container resulting from a hot-filling, capping and cooling thereof and, wherein said annulus comprises a substantially sinusoidal-shaped groove extending about said periphery of the container.

22. The container according to claim 21, wherein each of said plurality of active surfaces further comprises an initiator portion and a flexure portion.

23. The container according to claim 22, wherein said initiator portion and said flexure portion are positioned substantially parallel to and in the direction of said longitudinal axis within each of said plurality of active surfaces.

24. The container according to claim 23, wherein at least one of said initiator portions is positioned above said substantially sinusoidal-shaped groove and at least another of said initiator portions is positioned below said substantially sinusoidal-shaped groove.

25. In a blow-molded plastic container having an enclosed base portion, a body portion extending upwardly from the base portion and including an active cage that includes a plurality of active surfaces, each of which further comprises an initiator portion and a flexure portion, wherein the initiator portion is longitudinally displaced from the flexure portion and is, thereby, adapted to accommodate vacuum-induced volumetric shrinkage of the container resulting from a hot-filling, capping and cooling thereof, and a top portion with a finish extending upwardly from the body portion, the improvement comprising inverting the active cage.

26. In a blow-molded plastic container having an enclosed base portion, a body portion extending upwardly from the base portion, and a top portion with a finish extending upwardly from the body portion, wherein the body portion includes a periphery and an active cage disposed about the periphery, and the active cage includes a plurality of active surfaces, each of which further comprises an initiator portion and a flexure portion, wherein the initiator portion is longitudinally displaced from the flexure portion to accommodate vacuum-induced volumetric shrinkage of the container resulting from a hot-filling, capping and cooling thereof, the improvement comprising inverting the active cage.

27. An inverted active cage for a plastic container, comprising:

a plurality of active surfaces, each of which is outwardly displaced with respect to a longitudinal axis of the container; and a network of pillars, each of which is inwardly displaced with respect to said longitudinal axis;

wherein said plurality of active surfaces together with said network of pillars are spaced about a periphery of the container in order to accommodate vacuum-induced volumetric shrinkage of the container resulting from a hot-filling, capping and cooling thereof.

28. The inverted active cage according to claim 27, further comprising an annulus.

29. An inverted active cage for a plastic container, comprising:

a plurality of active surfaces, each of which is outwardly displaced with respect to a longitudinal axis of the container; and a network of pillars, each of which is inwardly displaced with respect to said longitudinal axis; and an annulus comprising a waist;

wherein said plurality of active surfaces together with said network of pillars are spaced about a periphery of the container in order to accommodate vacuum-induced volumetric shrinkage of the container resulting from a hot-filling, capping and cooling thereof.

* * * * *

UNITED STATES PATENT AND TRADEMARK OFFICE

CERTIFICATE OF CORRECTION

PATENT NO. : 6,779,673 B2
APPLICATION NO. : 10/196551
DATED : August 24, 2004
INVENTOR(S) : David Murray Melrose et al.

It is certified that error appears in the above-identified patent and that said Letters Patent is hereby corrected as shown below:

Title Page

(56) References Cited, Foreign Patent Documents:
FR 90,987 3/1968

Column 1, line 8, change "Go et al." to Ogg et al.

Column 1, line 44, change "fiat" to flat.

Column 6, line 20, change "oresent" to present.

Signed and Sealed this

Eleventh Day of May, 2010

David J. Kappos

David J. Kappos
*Director of the United States Patent and Trademark Office*